US005705032A

United States Patent [19]

Harbinson et al.

[11] Patent Number: 5,705,032

[45] Date of Patent: Jan. 6, 1998

[54] BLACK LIQUOR VISCOSITY CONTROL

[75] Inventors: John N. Harbinson, Scarborough; David Todd R. Ellenor, Pickering, both of Canada

[73] Assignee: Thor Technology Corporation, North York, Canada

[21] Appl. No.: 605,865

[22] Filed: Feb. 23, 1996

[30] Foreign Application Priority Data

Feb. 23, 1995 [GB] United Kingdom ..... 9503562

[51] Int. Cl.[6] ..... D21C 11/00

[52] U.S. Cl. ..... 162/30.11; 162/29; 162/41

[58] Field of Search ..... 162/29, 30.1, 30.11, 162/41

[56] References Cited

U.S. PATENT DOCUMENTS 4,929,307 5/1990 Kiiskila et al. ..... 159/47.3

5,472,568 12/1995 Mullen et al. ..... 162/30.11

*Primary Examiner*—Donald E. Czaja

*Assistant Examiner*—Steven B. Leavitt

*Attorney, Agent, or Firm*—Sim & McBurney

[57] ABSTRACT

Black liquor is subjected to high shear to cause a breakdown of macromolecules contained therein and provide a reduction in viscosity, thereby improving the processability of the black liquor and enabling the solids content to be increased.

25 Claims, 19 Drawing Sheets

BLACK LIQUOR VISCOSITY CONTROL

FIELD OF INVENTION

The present invention relates to a procedure for decreasing the viscosity of black liquor (spent pulping liquor) from a kraft or other pulp mill operation.

BACKGROUND TO THE INVENTION

In the kraft process, wood or other cellulosic material is pulped in a white liquor comprising sodium sulfide and sodium hydroxide to form wood pulp. The wood pulp is separated from the spent pulping liquor and further processed by washing and optionally bleaching.

The spent pulping liquor or black liquor is subjected to a recovery and regeneration cycle for forming fresh pulping liquor. Such procedure generally involves evaporation of the black liquor, smelting the concentrated black liquor, forming green liquor from the smelt by dissolving the solid mass in water and forming white liquor from the green liquor by recausticization.

As the proportion of water decreases in the black liquor during evaporation, the viscosity and solids content of the black liquor increase. As the viscosity increases, the black liquor becomes more difficult to handle. In general, however, for the same solids content, the higher the temperature of the black liquor, the lower the viscosity. It would be desirable to provide a high solids content concentrated black liquor at lower viscosity to improve the processability of the black liquor.

In U.S. Pat. No. 4,929,307, there is suggested a procedure for controlling the viscosity of black liquor by subjecting the same to a heating step above the cooking temperature. By effecting such heating step, it is possible to evaporate black liquor to a higher solids content.

SUMMARY OF INVENTION

The present invention employs an entirely new approach to black liquor viscosity control. It has been appreciated by the inventors that the viscosity of black liquor depends primarily on the proportion of macro-molecular lignin present in the liquor, the molecular weight of such lignin ranging from about 2,500 to as high as about 50,000, depending on the feedstock and the process stage and conditions, including pH. Often, the molecular weight ranges from about 3,000 to about 10,000 and the number of monomeric units from about 12 to about 30 per macromolecule.

In accordance with an aspect of the present invention, there is provided a process for controlling the viscosity of black liquor, which comprises subjecting the black liquor to physical conditions such as to effect shearing of black liquor macromolecules to decrease their molecular size.

In accordance with one preferred embodiment of the invention, there is provided a process of decreasing the viscosity of black liquor from a pulping operation, which comprises providing a concentrated black liquor from the pulping of hardwood or softwood pulps having a solids content of about 40 to about 85 wt%; heating said concentrated black liquor to a temperature of about 75° to about 300° C.; passing said concentrated black liquor through a high shear zone wherein macromolecules in said concentrated black liquor are subjected to physical conditions of high shear to effect, in a gap between a rotor and a stator of a high shear mixer operating at a peripheral velocity of rotor of at least about 10 m/s with the gap between rotor and stator of less than about 1 mm, molecular size reduction and achieve a decrease in viscosity of said concentrated black liquor of at least about 5%; and recovering the treated black liquor having decreased viscosity.

In accordance with another aspect of the invention, there is provided a process for decreasing the viscosity of black liquor from a pulping operation, which comprises processing the black liquor in equipment primarily intended to shear molecules for a time and at a temperature sufficient to effect a decrease in viscosity.

The decreased viscosity provided by the procedures of the present invention enables the processability of the black liquor to be improved and a higher solids content for feed to the recovery boiler.

GENERAL DESCRIPTION OF INVENTION

Figure 1:
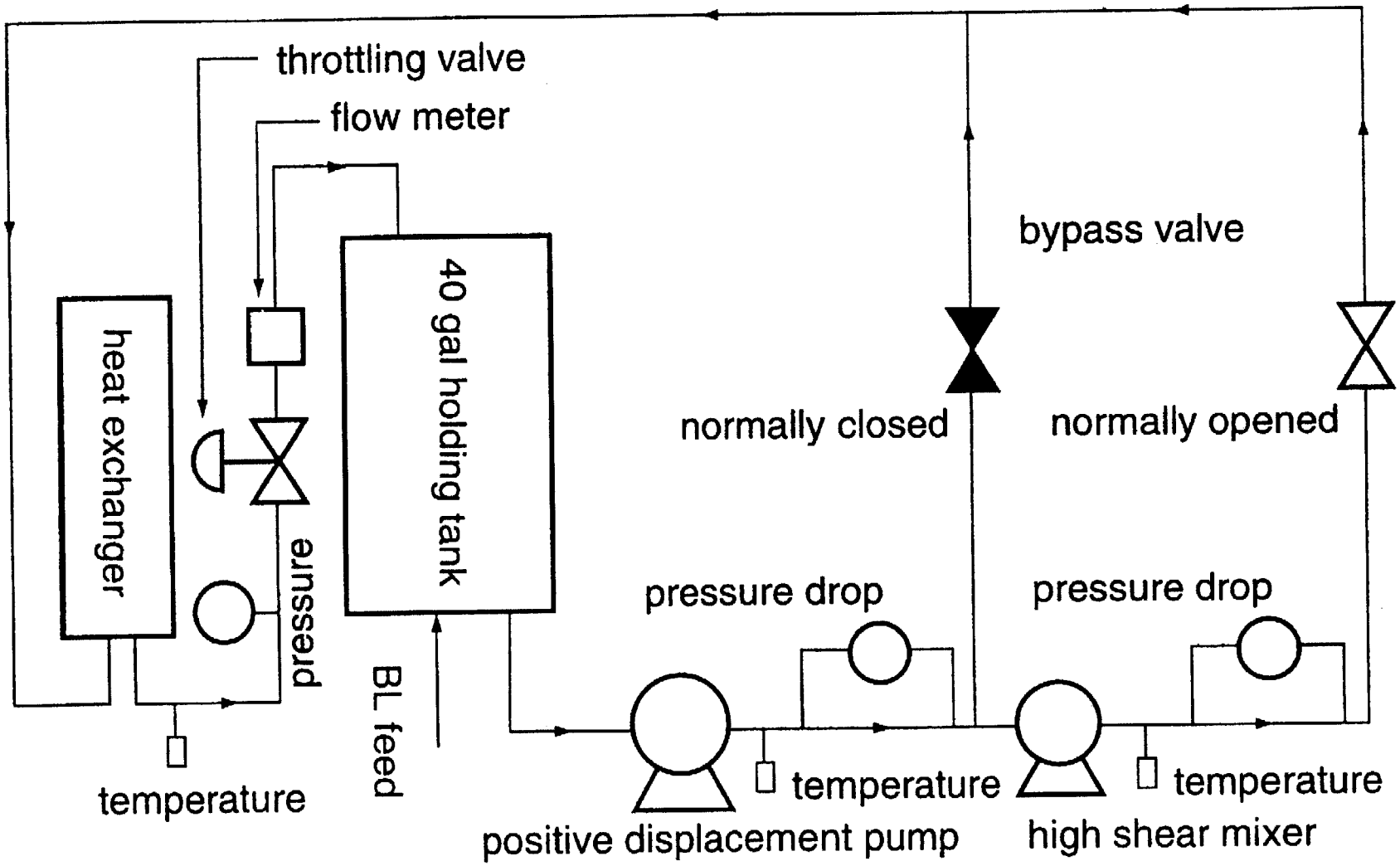
FIG. 1 is a schematic illustration of a pilot plant utilized in the experimentation described in the Example below.

As noted above, in the process of the present invention, black liquor is subjected to a shearing operation to decrease the viscosity of the black liquor. This procedure is quite different from known shear thinning of black liquor, which involves only a temporary reduction in viscosity as a result of an alignment of molecules rather than a breaking of molecules. The viscosity reduction obtained using the process of the invention is permanent and independent of other factors which may affect black liquor viscosity. The black liquor which is processed by the present invention may be from the pulping of both hardwood and softwood pulps.

The process of the invention is preferably effected on black liquor which first has been concentrated in accordance with normal procedures, generally to a solids content of about 40 to about 85 wt%, since the mechanical working of the black liquor is more effective at higher solids contents. However, black liquor having a lower solids concentration, down to about 15 wt%, also can be beneficially processed in accordance with the present invention and black liquor concentration up to about 90% may be processed and achieved following the procedures of the present invention. In general, the higher the solids content of the black liquor mechanically worked, the more effective are the shear forces in breaking down the macromolecules. The process also can be operated to provide black liquor with very high solids contents by effecting the process two or more times on the black liquor, with an intermediate concentration step to increase the viscosity and solids content of the processed black liquor. It is believed that the bonds in the macromolecules may be weakened by a temperature increase. An elevated temperature, generally from about 75° to about 300° C., preferably from about 140° to about 200° C., of operation of the shearing process of the present invention is preferred, since the black liquor is less viscous and can be more readily mechanically worked at the elevated temperatures.

Any degree of permanent reduction of the viscosity of black liquor is beneficial in improving the processability of the black liquor. In general, at least about 5% decrease in viscosity is achieved using the process of the invention and the higher the decrease which is attained the greater benefit can be derived from the process of the invention. The inventors have found that each 10% reduction in viscosity corresponds to about 1% reduction in solids content of the black liquor. As may be seen from the detailed Examples below, a 70% reduction in viscosity at 145° C. has been achieved. The decrease in viscosity which is attained according to the invention is permanent, while the shearing action on the macromolecules may lead to a rise in temperature of the black liquor, resulting in some decrease in viscosity, this result is transient.

The process of the invention may be effected using any desired device which is able to effect the required macromolecule shearing. A variety of commercial high shear equipment is available which is suitable for carrying out the process of the invention, including those available from Greerco, Ross, Silverson and Siefer. In general, high shear equipment employs a rotor and a stator with a narrow gap therebetween. The shear stress which is exerted in such equipment is determined by the viscosity of the material treated, the peripheral velocity of the rotor and the size of the gap, in accordance with the relationship:

Viscosity x v/d=shear stress where v is the peripheral velocity of the rotor and d is the width of the gap between rotor and stator. The peripheral velocity of a rotor generally exceeds about 10 m/s, preferably at least about 15 m/s, and may range up to about 45 m/s or higher. The width of the gap between rotor and stator may vary from less than about 0.1 mm to about 3 mm, generally about 0.1 to about 0.6 mm and preferably about 0.2 mm to about 0.4 mm.

The action of shearing of the black liquor in accordance with the invention may add heat to the black liquor, thereby enhancing the effect of the mechanical working of the black liquor. However, as noted above, the present invention does not involve a heat or shear thinning effect but rather a permanent reduction in black liquor viscosity.

The mechanical working of the black liquor effected herein to decrease the viscosity leads to a black liquor having improved evaporability, which increases the combustion value of the black liquor. The decreased viscosity improves the processability of the black liquor at the final stage before the recovery boiler. The shearing of the black liquor to lower its viscosity enables the black liquor to be concentrated to a higher solids content, which then provides a higher heat value, which may be advantageous in the recovery boiler.

The shearing of the black liquor effected herein normally is conducted at atmospheric pressure. It is possible, however, to effect the process under a superatmospheric pressure, if desired. During the shearing operation, a free-radical inhibitor, such as an oxidizing agent or oxygen gas, may be added to the black liquor to inhibit recombination of degraded components. Moreover, when anthraquinone has been used in the cooking process, or in black liquor treatment as provided herein, it may be necessary to adjust the alkalinity of the black liquor by adding white liquor or caustic soda, to inhibit recombination of lignin fragments.

The procedure of the invention may be effected at one or more locations of processing of the black liquor in the pulp mill, for example, before wash water is added to the black liquor, between stages of evaporation, before final evaporation and after final evaporation.

In one embodiment of the invention, a catalyst may be added to the black liquor to enhance the decomposition thereof during the shearing operation. Suitable catalysts include Lewis bases, such as an amine, which may assist in the breaking of carbon-carbon bonds and/or carbon-sulphur bonds. Other catalysts which may be used include those used to break such and similar bonds in related processes, such as the devulcanization of tire rubber, for example, as disclosed in published PCT patent application Ser. No. WO 94/14896, or those used to increase yield and reduce pulping severity, such as anthraquinone.

It is well known that, at a given solids content and temperature, the viscosity of black liquor may be affected by the addition of alkali, oxidation and hot storage. In general, addition of alkali to black liquor with lower residual alkali leads to a decrease in viscosity while addition of alkali to black liquor with a higher residual alkali leads to an increase in viscosity. It is also known that the alkalinity of the black liquor should be maintained in the range of about 2.5 to about 4%, since at low alkalinity lignin fragments repolymerize or gel to form very viscous suspensions. Accordingly, the residual alkali content of the black liquor should be carefully managed to ensure a minimum viscosity of the black liquor. In the present invention, the alkalinity following shearing generally is controlled to be at least about 2% and preferably greater than about 2.5%. As noted earlier, the viscosity reduction obtained using the present invention is permanent and this effect is assisted when the alkalinity of the black liquor is sufficiently high to prevent repolymerization or gelling of lignin fragments.

Similarly, oxidation changes the viscosity of black liquor since such action reduces the residual alkali concentration at low residual alkali contents, oxidation of the black liquor tends to result in an increased viscosity while oxidation of high residual alkali black liquor results in a decreased viscosity. This viscosity change is reversible, so that adding alkali to oxidized black liquor returns the liquor to the original viscosity.

The present invention achieves a decrease in viscosity of the black liquor which is independent of these effects.

The process of decreasing black liquor viscosity effected herein may be combined with a procedure of oxidizing black liquor, also as described in U.S. Pat. No. 4,929,307, using any suitable equipment, for example, that described in U.S. Pat. No. 5,174,973. The rotor and stator of such equipment may be designed in such a manner that, when they are placed near or just below the surface of the black liquor, a vortex may be created and a gas from the head space, such as, air or steam, draws down into and intimately mixed with the black liquor by the action of the rotor.

While the procedure described herein is specifically applicable to the processing of black liquor produced in a kraft pulp mill operation, the process also may be used for decreasing the viscosity of spent pulping chemicals containing significant quantities of macro-molecular lignin from any other pulping procedure.

EXAMPLES

Example 1

This Example illustrates the black liquor viscosity reduction process of the invention.

A batch operated bench scale pilot plant was constructed comprising a high-shear mixer, positive displacement pump, heat exchanger, reservoir, temperature probes, differential pressure transmitters, viscosity tubes, sample ports, catalyst port, current probe and data acquisition unit, as illustrated in FIG. 1. The high-shear mixer was manufactured by Greerco Corporation, model Gifford-Wood 2" Horizontal, Tandem-Shear Pipeline mixer operating at approximately 7000 rpm with a peripheral speed of 13 m/s and a gap of 0.3 mm.

Figure 2:
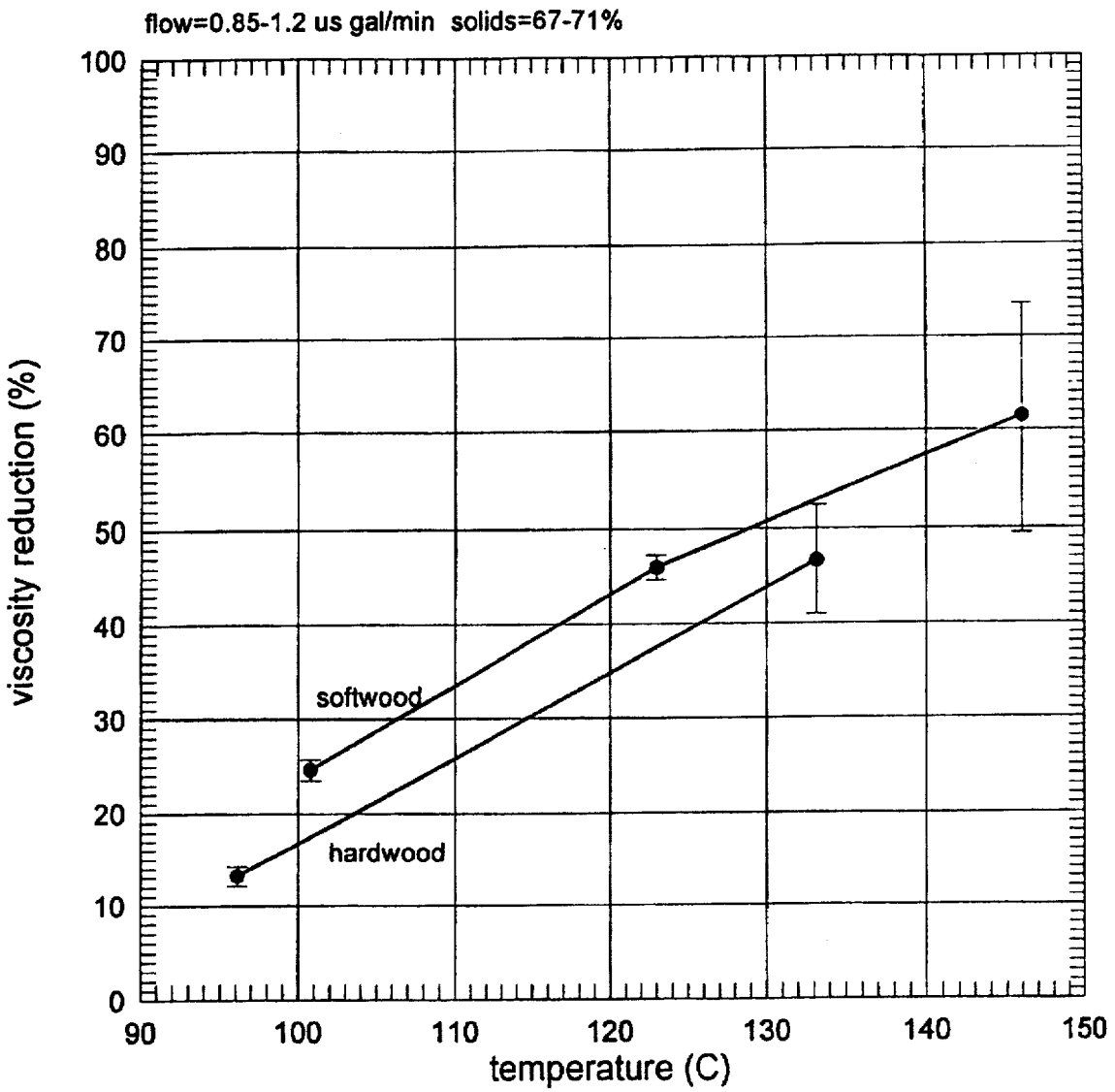
FIG. 2 shows in graphical form the variation of reduction in viscosity versus temperature for a sample hardwood black liquor at a solids content of approximately 69%.

A typical run of the pilot plant of FIG. 2 consisted of filling the system with approximately 40 U.S. gallons of black liquor (BL). BL was then recirculated and heated without shearing until the desired temperature was reached. The BL was then passed through the shear mixer. The positive displacement pump was used to pump the liquor around the circuit. The pumping action of the shear mixer was eliminated by the throttling valve located downstream the mixer.

Liquor temperature and pressure drop in a length of tube from the pump discharge was measured and recorded. The same measurements were made with an identical setup on the discharge side of the high shear mixer. Liquor flow was measured in the return line to the holding tank. Measurements of viscosity reduction were made over a time less than that required to completely recirculate all BL. This simulated an inline process with no recirculation.

The calculation of viscosity was based on laminar flow in a circular cross-section tube. The estimated highest Reynolds number was approximately 800 and was based on a tube diameter of 0.0221 m, density of 1,400 kg/m$^3$, viscosity of 35 cp and flow of 5 US gal/min. Viscosity was calculated from the pressure drop in a 4.19 m length of tube. The following equation was used to calculate viscosity from pressure drop and flow $$\mu = \frac{\Delta P \pi d^4}{128 Q L} \rightarrow \mu^* = 5.51 \frac{\Delta P^*}{Q^*}$$

where $\mu^*$ is viscosity (cp), $\Delta P^*$ is pressure drop (in $H_2O$) and $Q^*$ is flow (US gal/min). Percent reduction in viscosity is reported as the change in viscosity divided by the original viscosity $$\text{viscosity reduction} = \frac{(\mu^*)_{before\ shear} - (\mu^*)_{after\ shear}}{(\mu^*)_{before\ shear}} = \frac{(\Delta P^*)_{before} - (\Delta P^*)_{after}}{(\Delta P^*)_{before}}$$

Experimental results are given in FIGS. 2 to 19. The results are summarized in FIG. 2 and 5. FIG. 2 shows percent viscosity reduction versus temperature for sample hardwood and softwood BLs. The results were obtained at a flow of approximately 1 gal/min and the solids content was approximately 69%. The results indicate that the largest reductions were obtained at the highest temperatures. Softwood liquors undergo a larger viscosity reduction.

Figure 3:
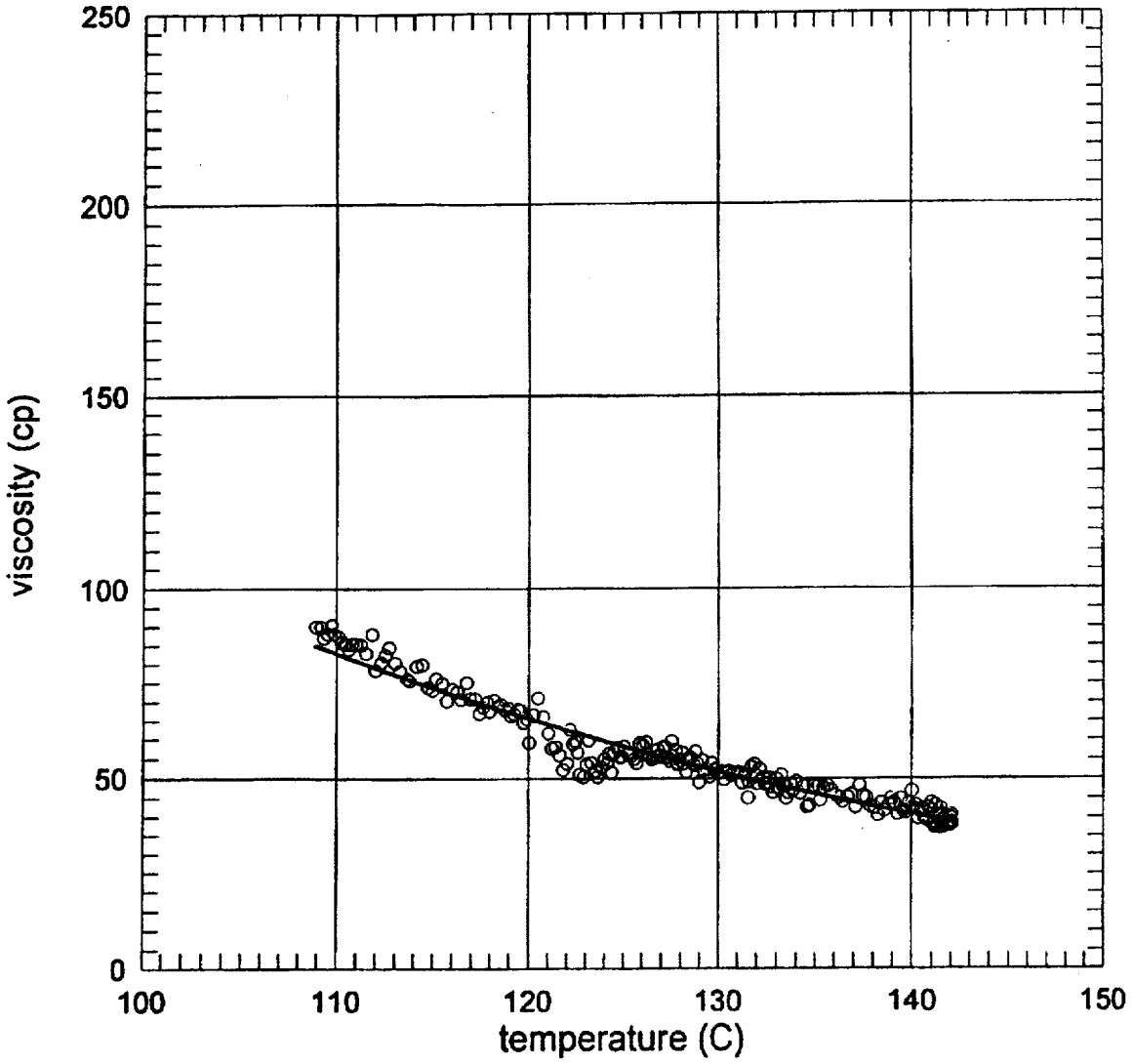
FIG. 3 shows in graphical form the variation in viscosity versus temperature for a sample softwood black liquor before heating to 142° C. and holding for 2 hours. The results were compared with the results given in FIG. 4 after heat treatment.
Figure 4:
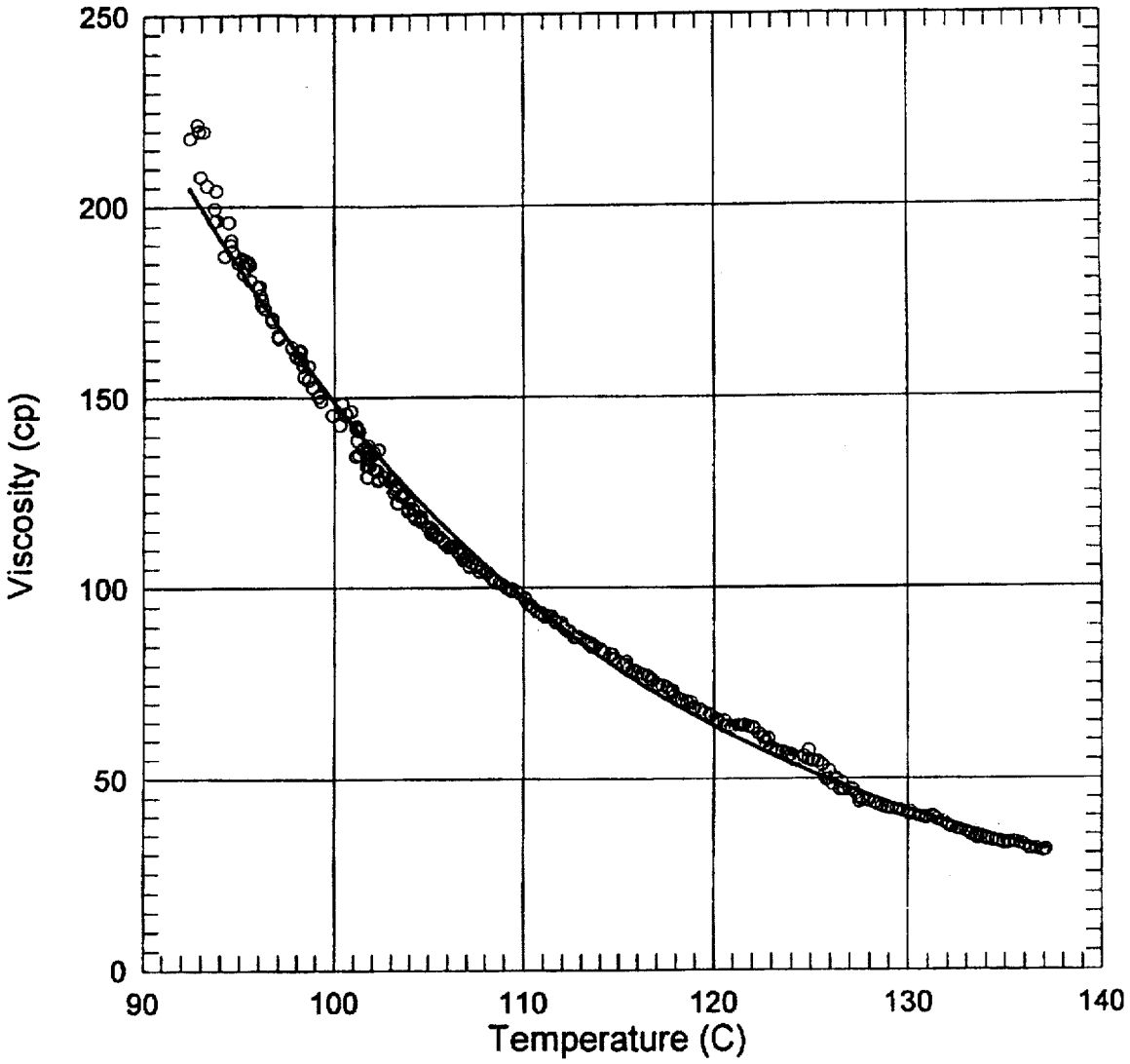
FIG. 4 shows in graphical form the variation in viscosity versus temperature for a softwood black liquor after heating to 142° C. and holding for 2 hours. The results obtained were compared with the results given in FIG. 3 before heat treatment. This comparison shows a negligible heat treatment effect.

Viscosity reduction measurements are essentially instantaneous, so that the results shown in FIG. 2 do not depend in a "heat treatment" effect (holding at an elevated temperature for some time). BL was heated to 142° C. and held for approximately 2 hours to heat treat it. Viscosity measured before heat treat and after heat treat were approximately the same. Note that viscosity reduction brought about by heat treatment depends strongly on the composition of the liquor. Viscosity can increase after heat treatment. These results are given in FIGS. 3 and 4. FIG. 3 is the viscosity of the liquor before heating and FIG. 4 shows the viscosity after holding the liquor at 142° C. for 2 hours.

Figure 5:
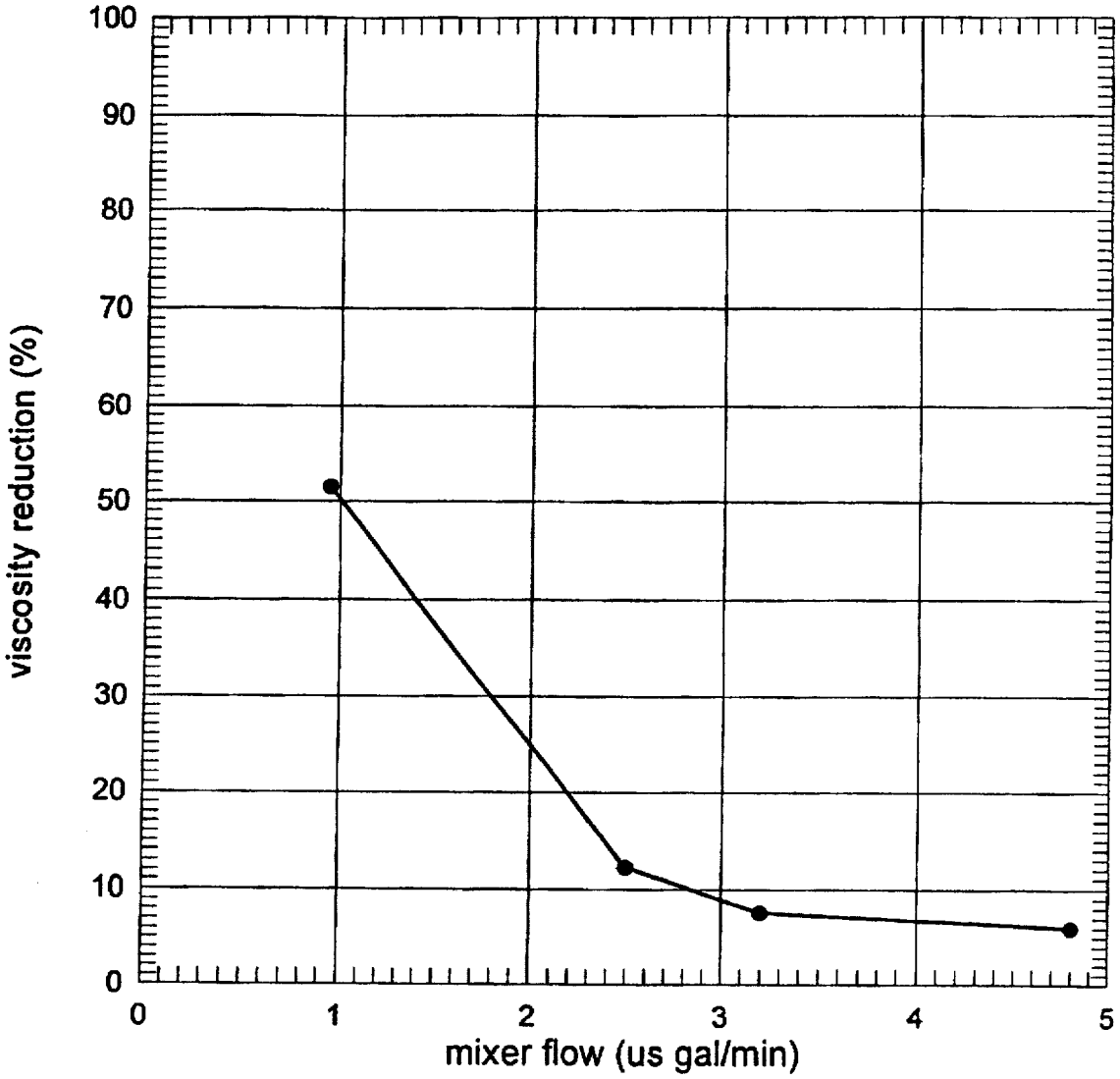
FIG. 5 shows in graphical form the variation in viscosity reduction versus black liquor flow rate through the mixer for a sample hardwood black liquor at 141° C.
Figure 6:
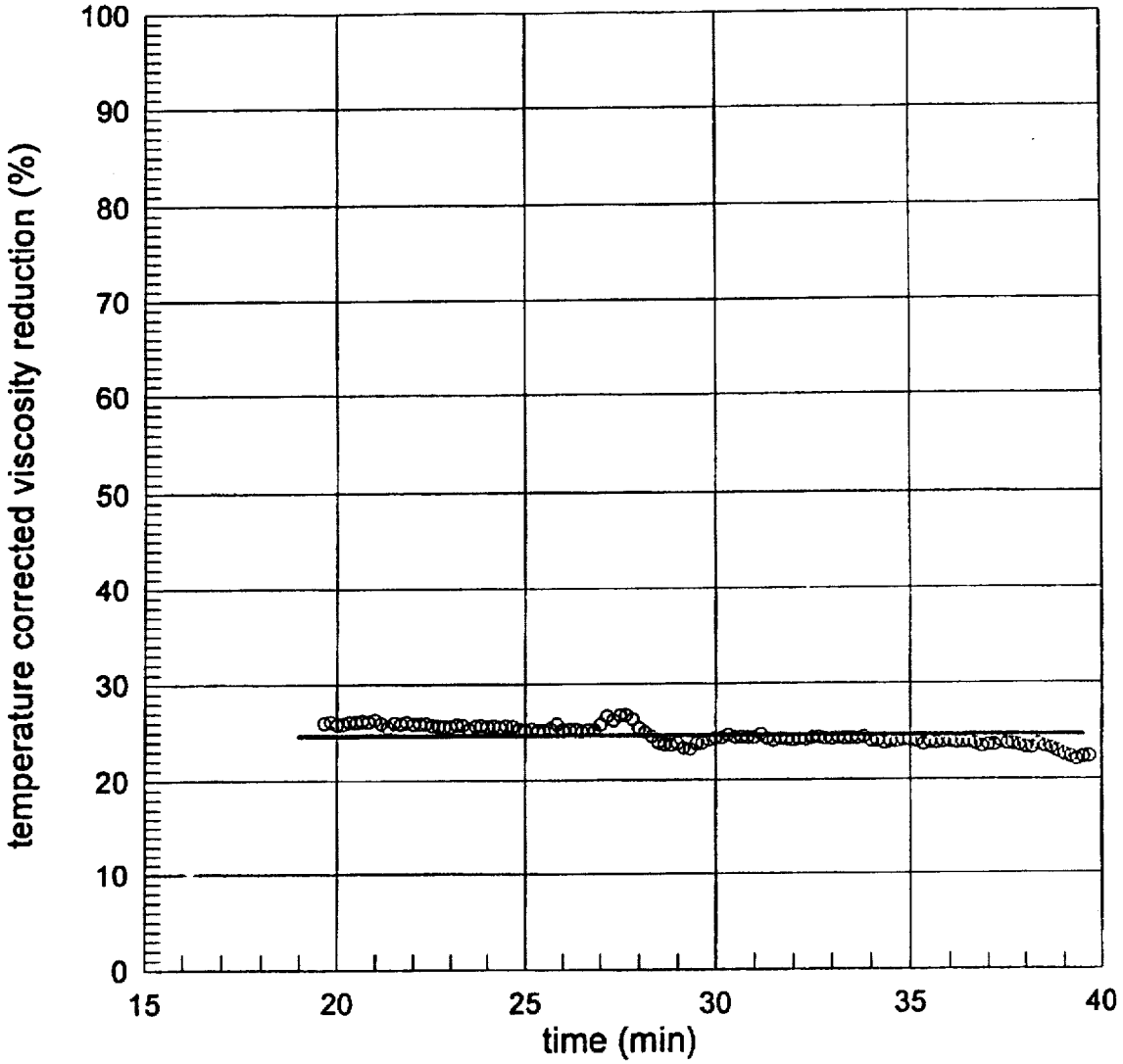
FIG. 6 shows in graphical form temperature corrected viscosity versus time for a softwood black liquor, T=100.8±0.1° C., solids=67%, Q=0.99±0.01 U.S. gal/min, viscosity reduction=24.6±1.1%, temperature rise after shearing=3.08±0.09° C.
Figure 7:
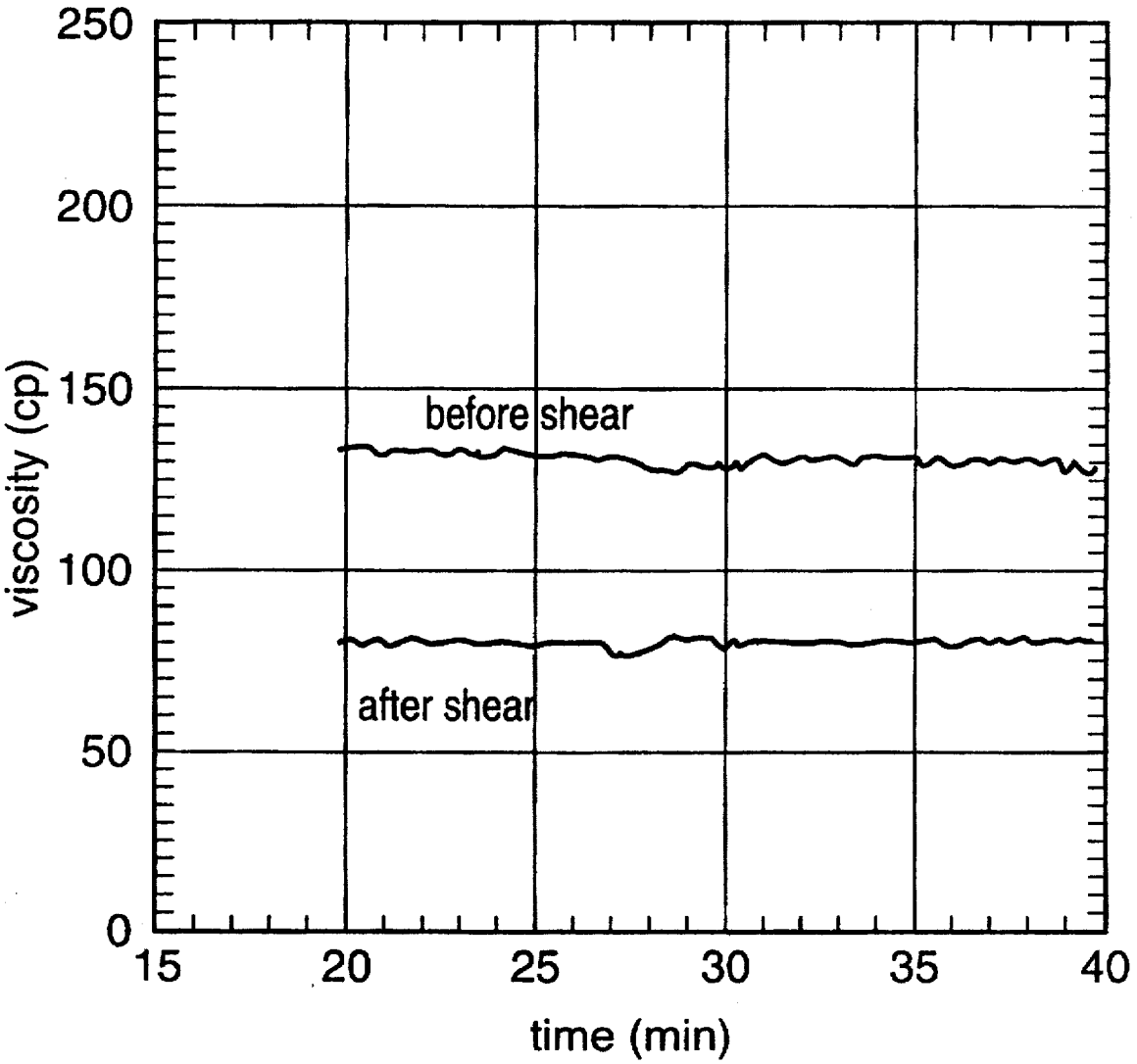
FIG. 7 shows in graphical form viscosity versus time before and after shearing (see FIG. 6 for viscosity reduction)
Figure 8:
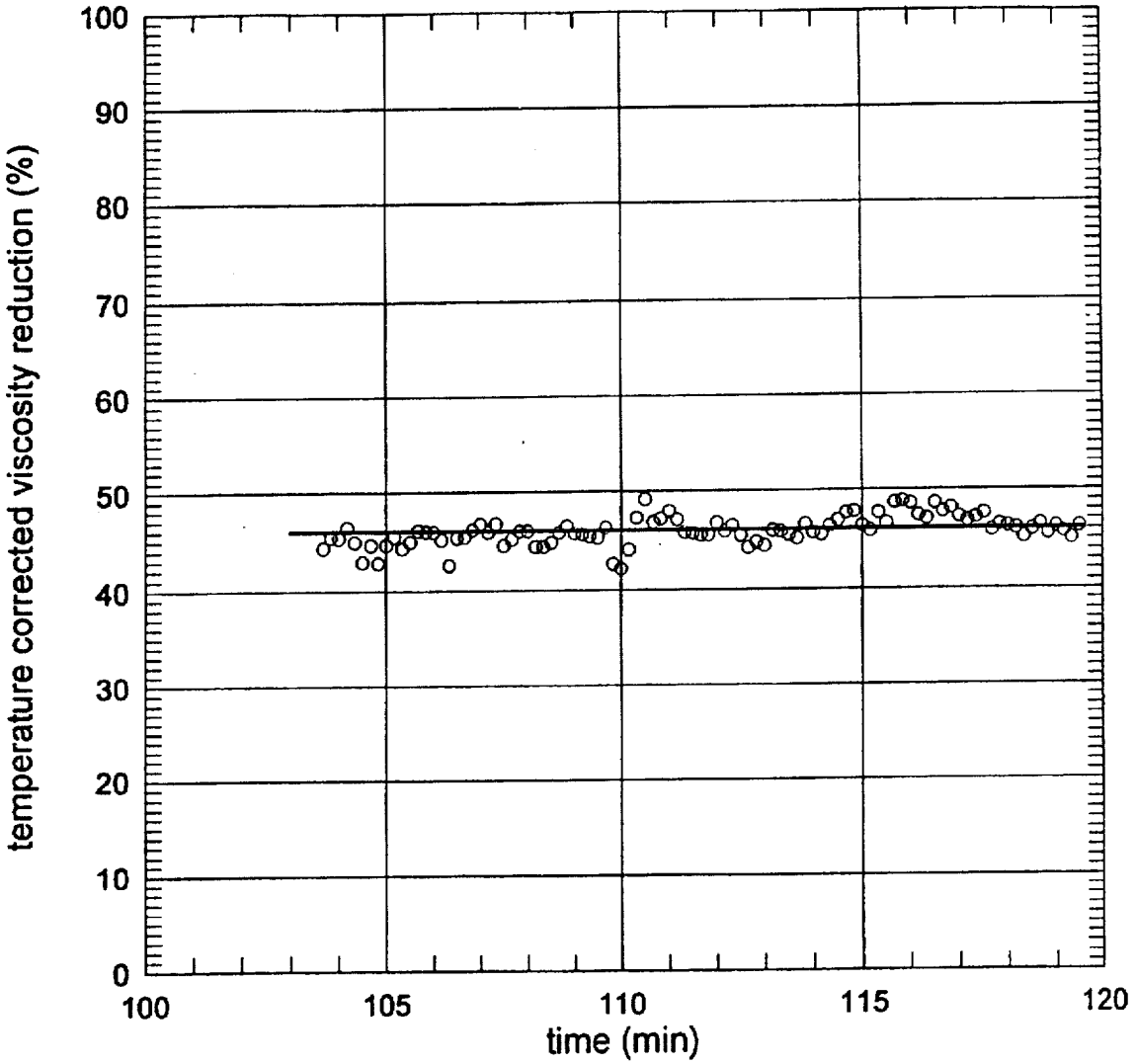
FIG. 8 shows in graphical form temperature corrected viscosity reduction versus time for a softwood black liquor. T=123.8±0.1%, solids=69%, Q=0.88±0.03 U.S. gal/min, viscosity reduction=46±1.3%, temperature rise after shearing=2.06±0.04° C.
Figure 9:
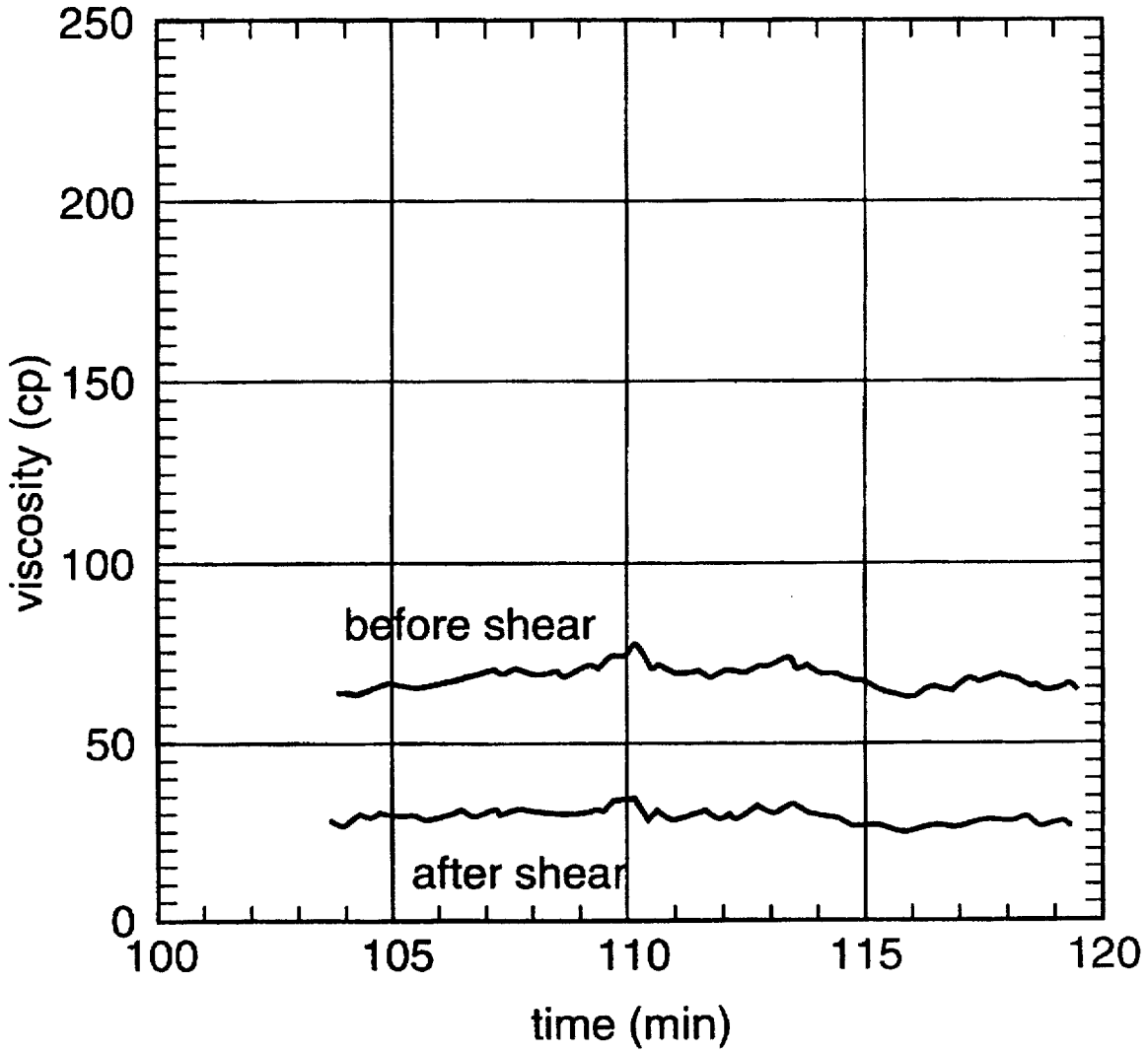
FIG. 9 shows in graphical form viscosity versus time before and after shearing (see FIG. 8 for viscosity reduction).
Figure 10:
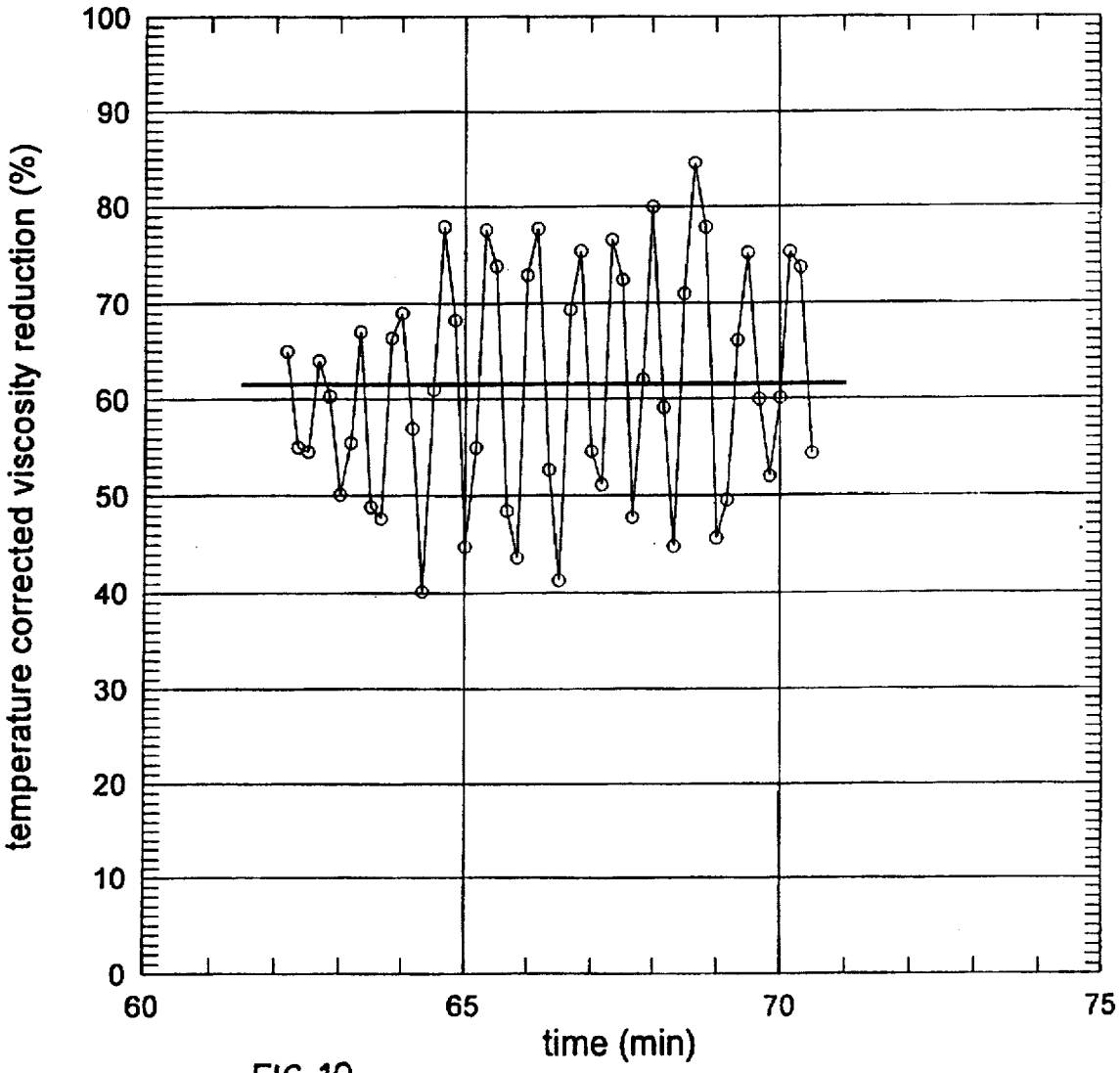
FIG. 10 shows in graphical form temperature corrected viscosity reduction versus time for a softwood black liquor. T=146±0.1%, solids=68.4%, Q=1.16±0.03 U.S. gal/min, viscosity reduction=61.5±12%, temperature rise after shearing=1.2±0.04° C.
Figure 11:
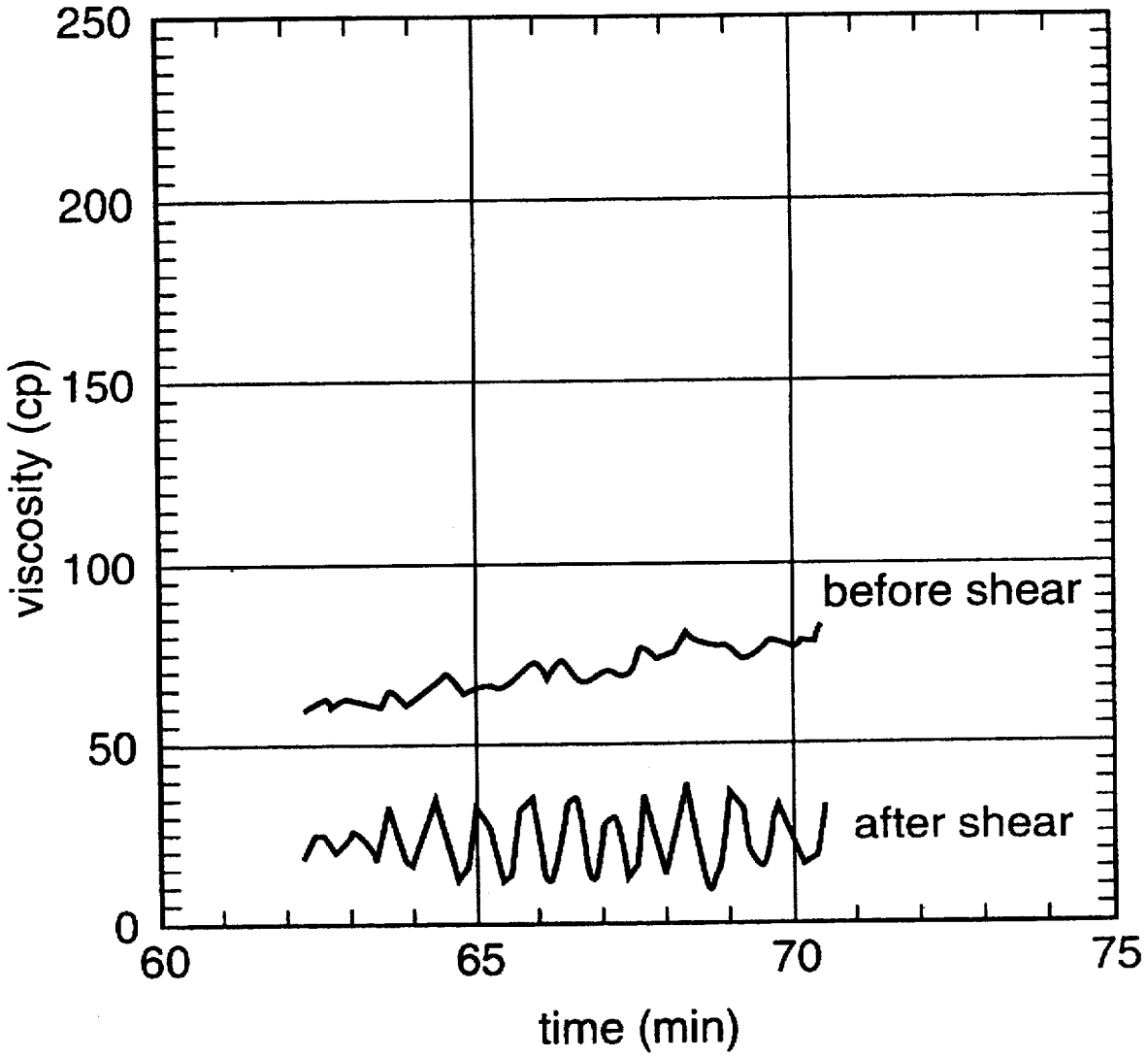
FIG. 11 shows in graphical form viscosity versus time before and after shearing (see FIG. 10 for viscosity reduction)
Figure 12:
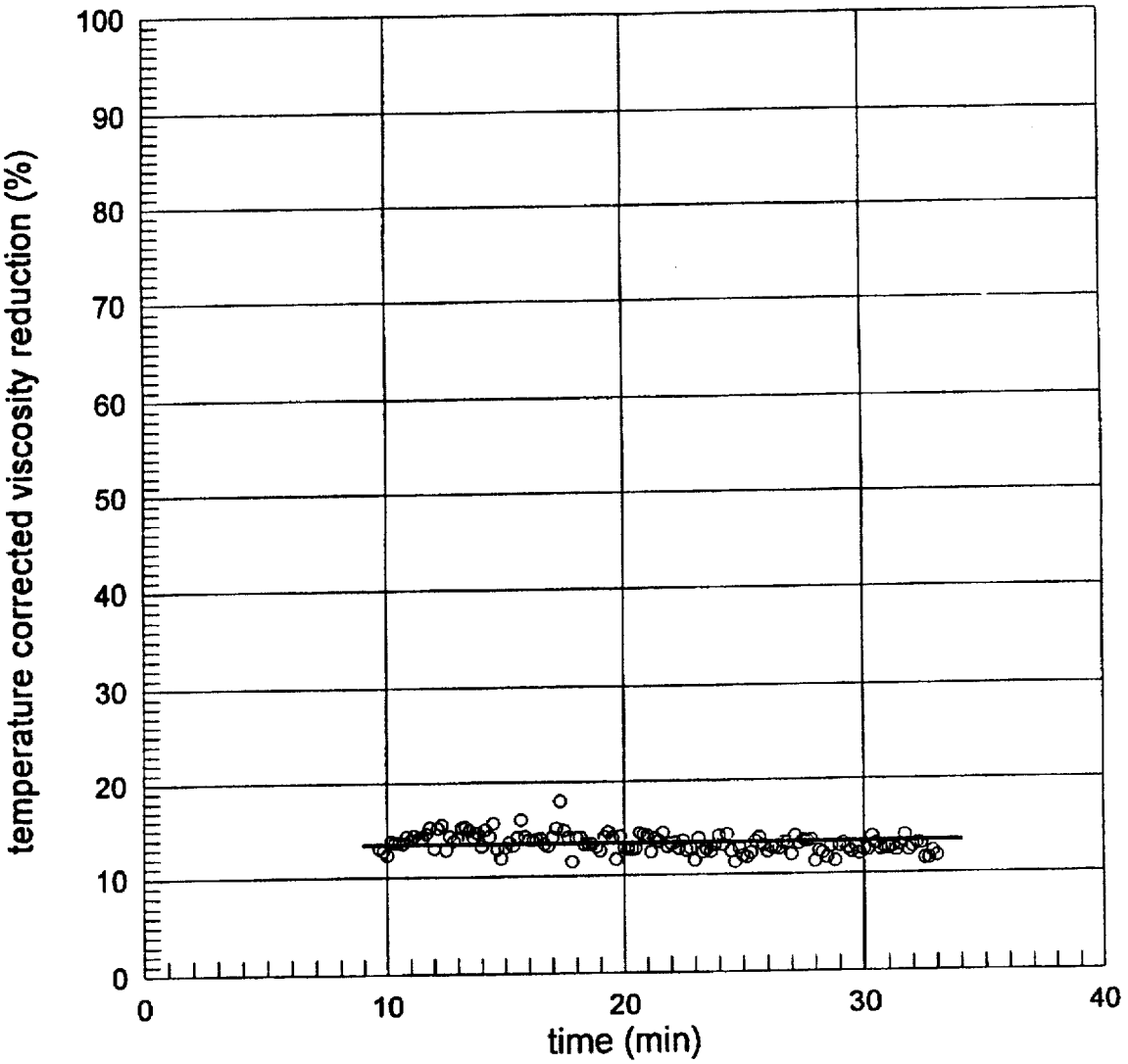
FIG. 12 shows in graphical form temperature corrected viscosity versus time for a hardwood black liquor. T=96.1±0.0° C., solids=70.3%, Q=0.98±0.00 U.S. gal/min, viscosity reduction=13.2±1.05%, temperature rise after shearing=4.73±0.12° C.
Figure 13:
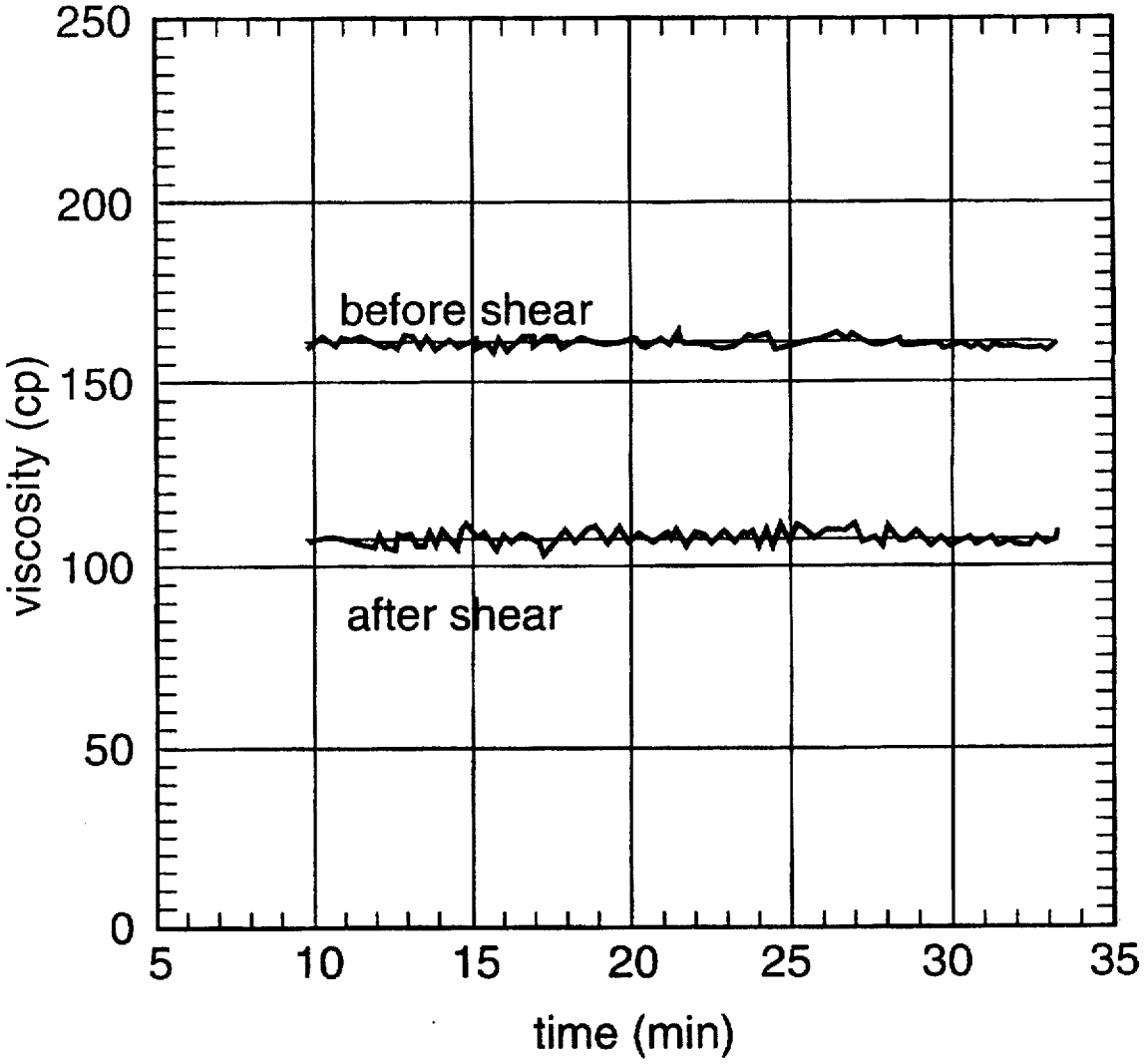
FIG. 13 shows in graphical form viscosity versus time before and after shearing (see FIG. 12 for viscosity reduction).
Figure 14:
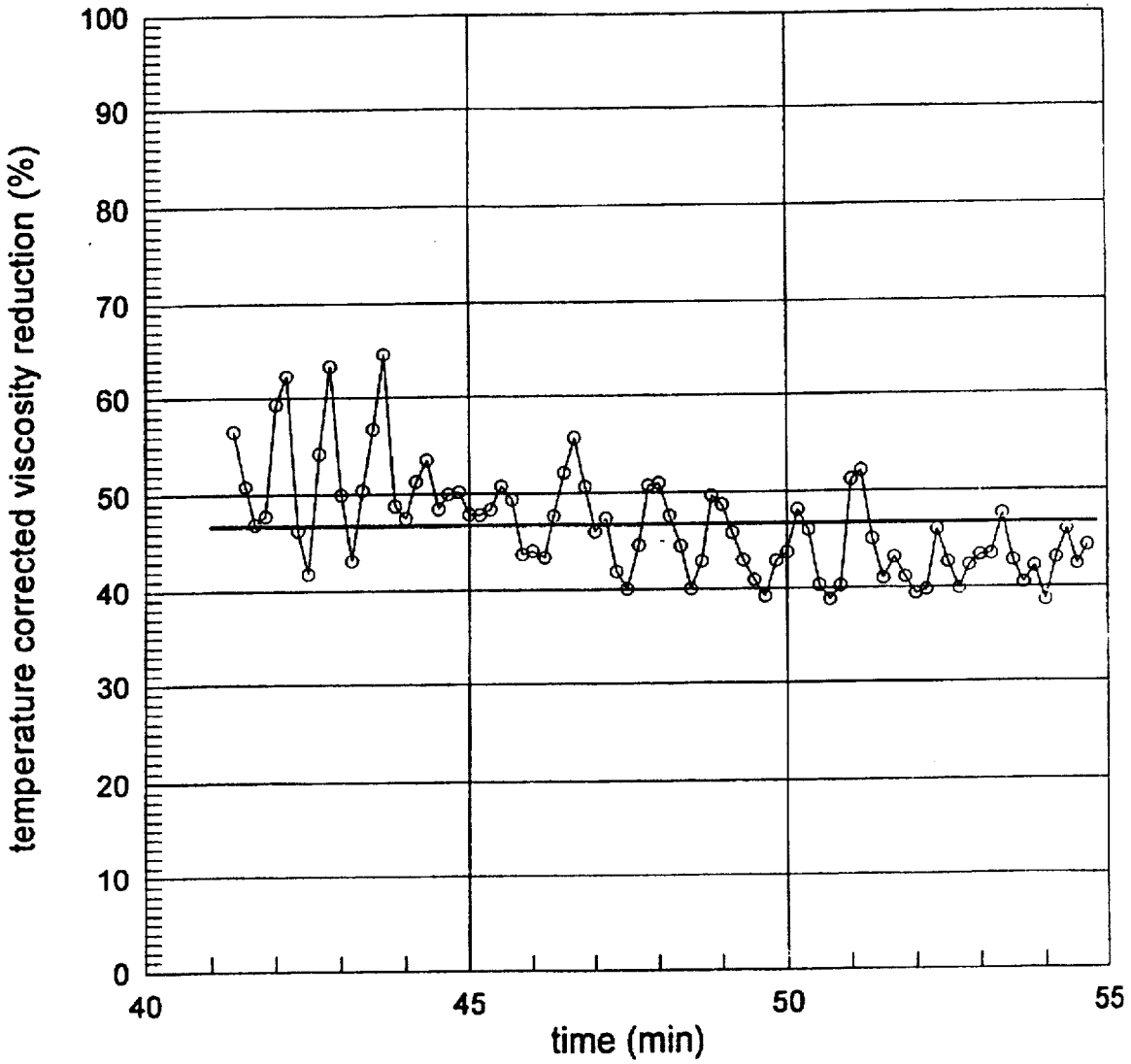
FIG. 14 shows in graphical form temperature corrected viscosity reduction versus time for a hardwood black liquor. T=133.2±0.3° C., solids=70.3%, Q=1.02±0.15 U.S. gal/min, viscosity reduction=46.7 ±5.7%, temperature rise after shearing=2.64±0.12° C.
Figure 15:
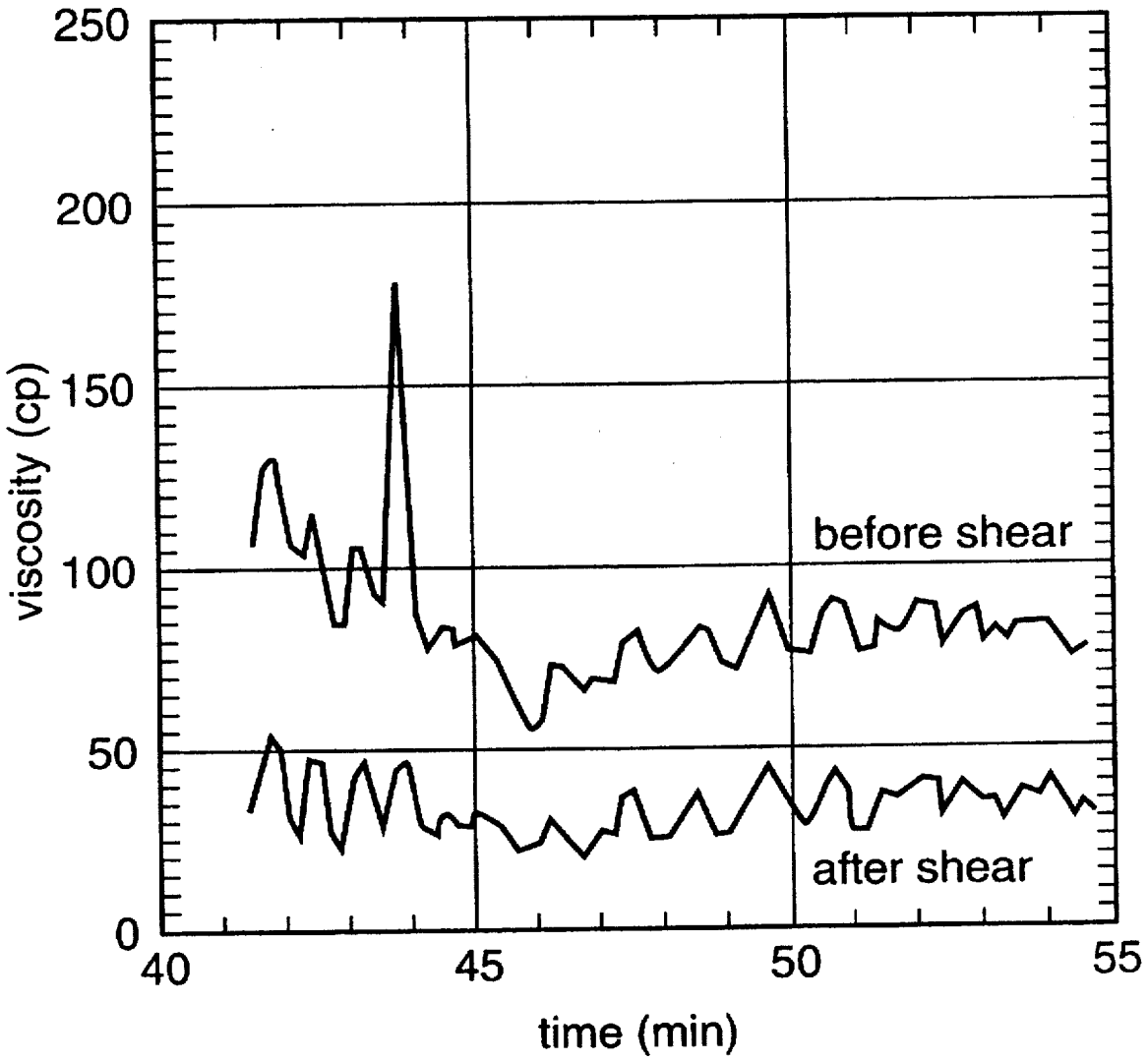
FIG. 15 shows in graphical form viscosity versus time before and after shearing (see FIG. 14 for viscosity reduction)
Figure 16:
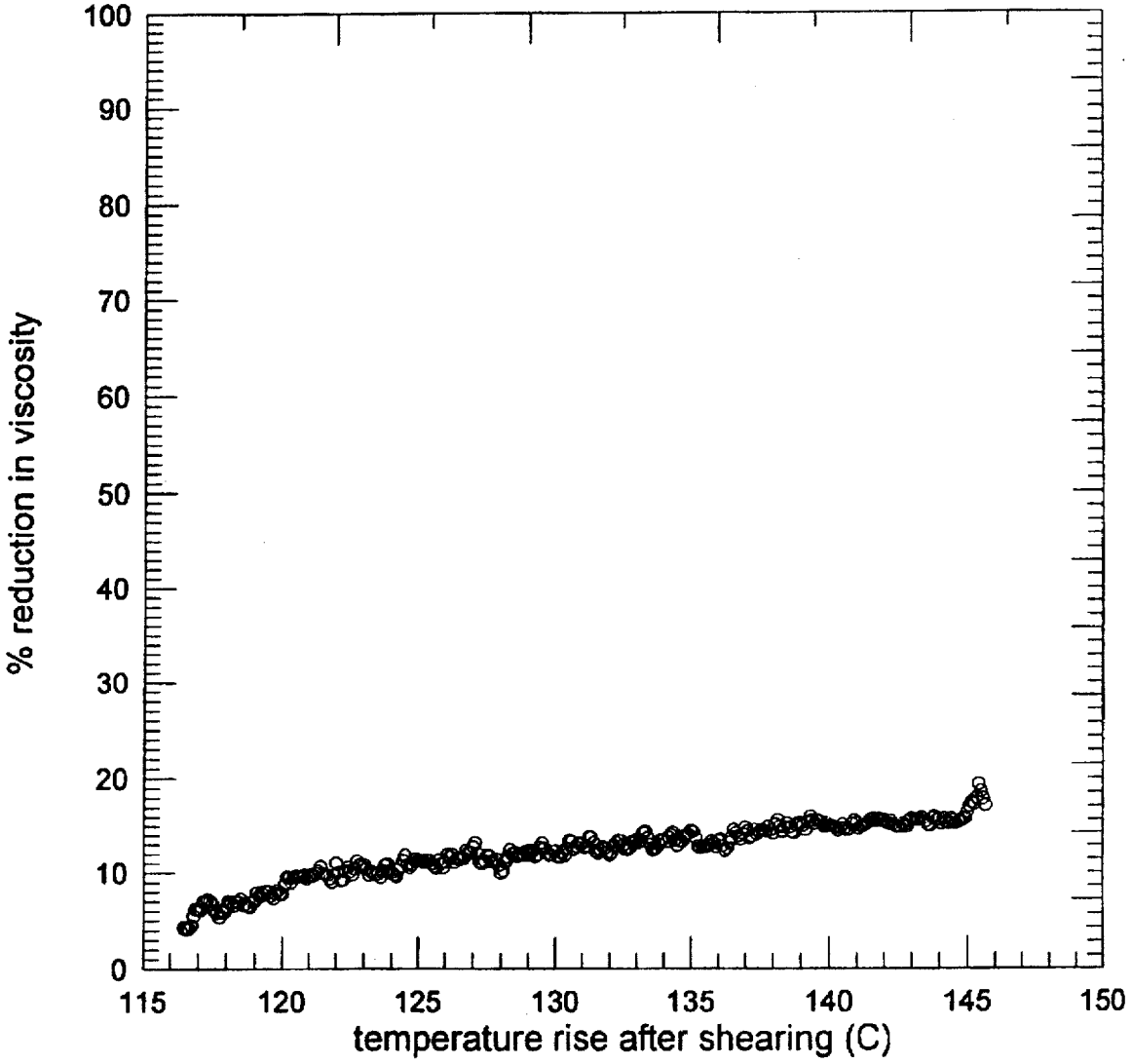
FIG. 16 shows in graphical form temperature corrected viscosity reduction versus time for a hardwood black liquor. T=141.4° C., solids=68%, Q=2.5 U.S. gal/min, viscosity reduction=12.2±2.9%, temperature rise after shearing=0.5±0.03° C.
Figure 17:
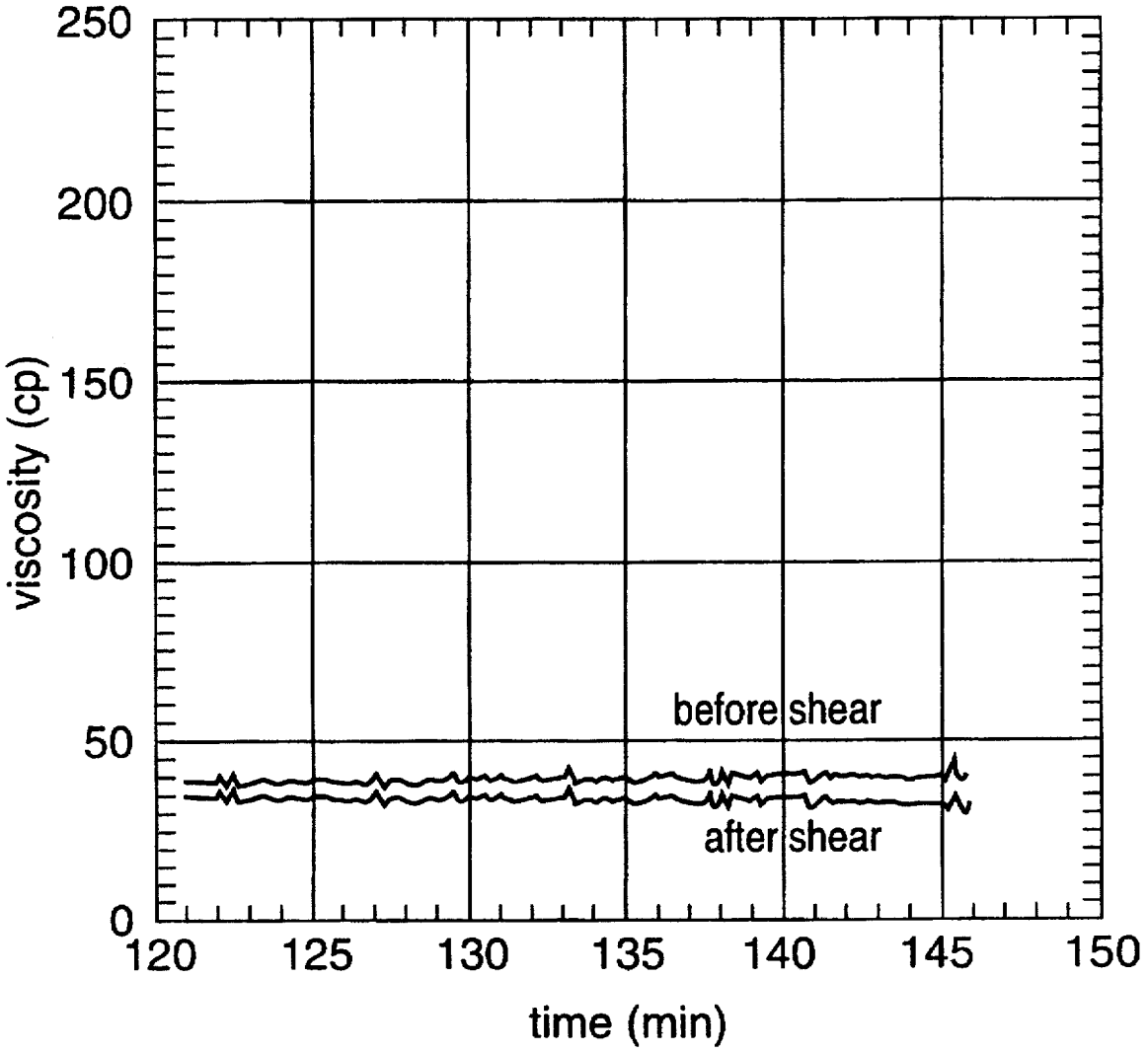
FIG. 17 shows in graphical form viscosity versus time before and after shearing (see FIG. 17 for viscosity reduction)
Figure 18:
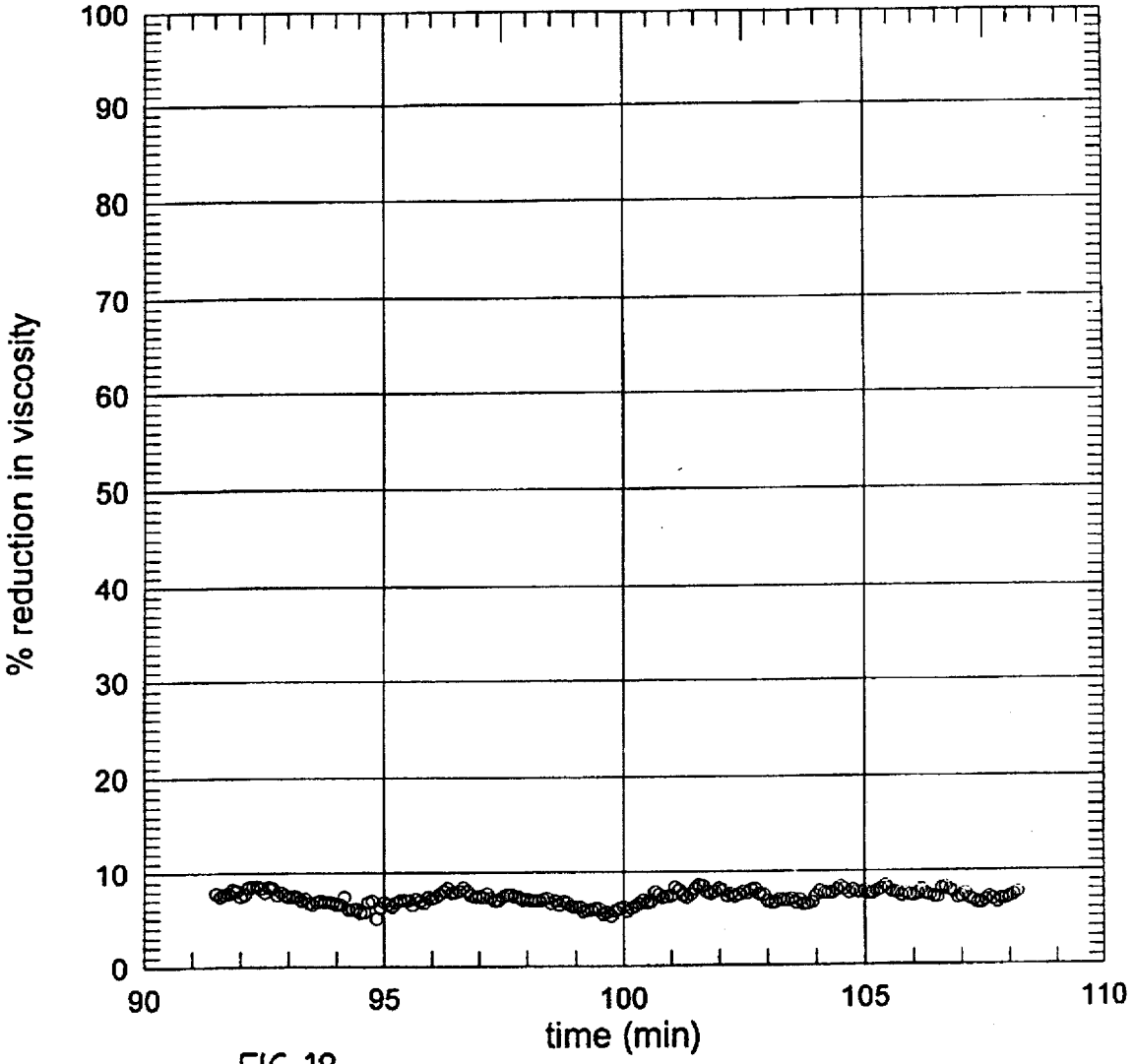
FIG. 18 shows in graphical form temperature corrected viscosity versus time for hardwood black liquor. T=141.5° C., solids=68%, Q=3.2 U.S. gal/min, viscosity reduction=7.6±1.8%, temperature rise after shearing=0.3±0.1° C.
Figure 19:
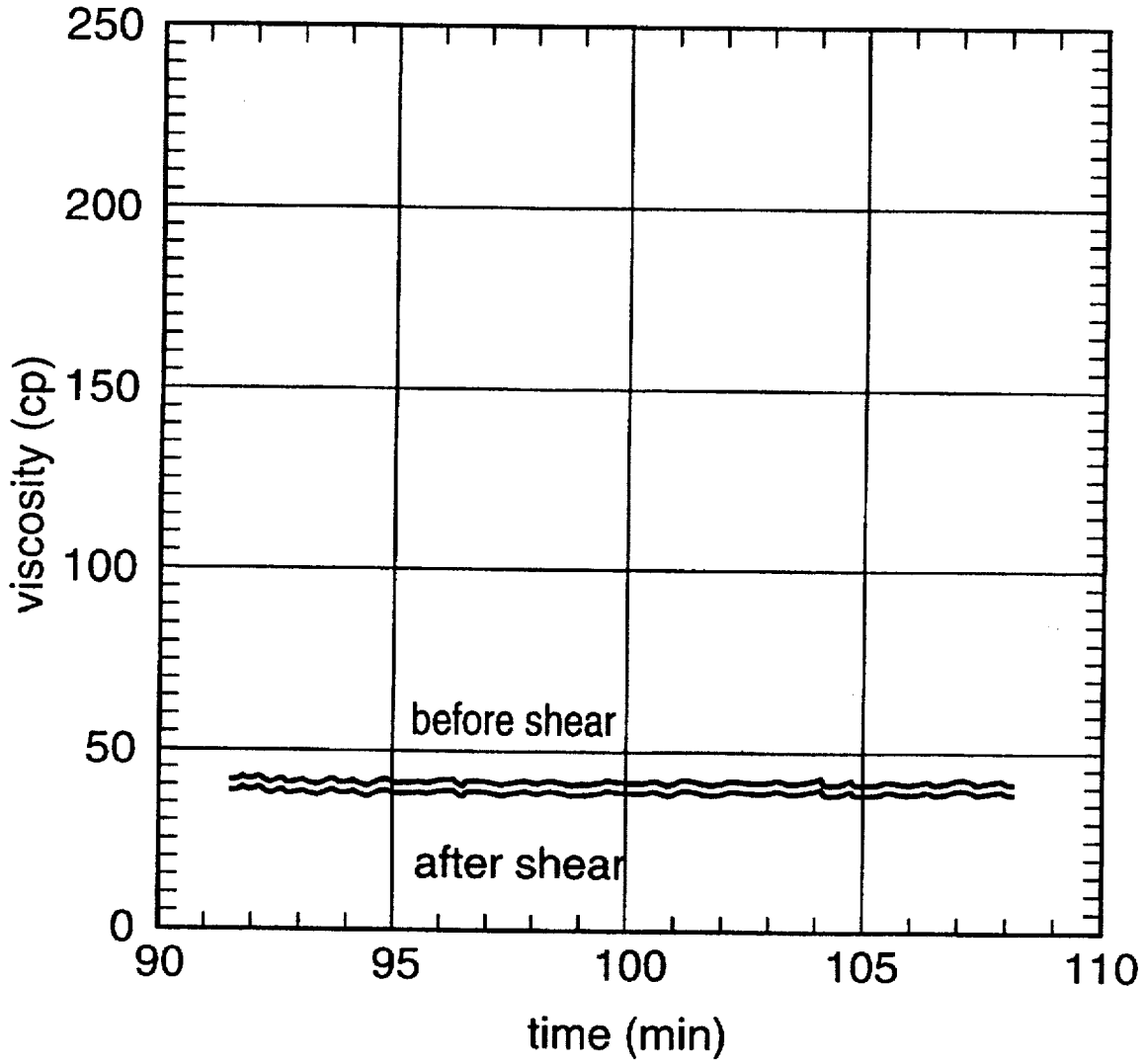
FIG. 19 shows in graphical form viscosity versus time before and after shearing (see FIG. 18 for viscosity reduction).

FIG. 5 shows the effect of reducing the flow through the high shear mixer at T=141° C. for typical hardwood liquors, solids=69%. For the mixer used, the black liquor should be less than 1 gal/min to achieve large reductions in viscosity. The rest of the Figures give the data used in FIGS. 2 and 5.

The experimental results indicate that high temperatures and low flow through the mixer causes a greater reduction in viscosity.

From the results presented herein, it can be seen that, high shear causes a significant reduction in viscosity. At T=146° C. and a flow of approximately 1 gal/min through the shear mixer, the viscosity of 69% solids is reduced by approximately 61% for softwood liquor. At T=134° C. hardwood liquor (solids=70%) viscosity was reduced 45% by high shear.

Example 2

This Example illustrates the permanent nature of the viscosity reduction achieved herein.

Black liquor was processed according to the procedure of Example 1. A treated sample was measured for viscosity two weeks after processing. The results are set forth in the Table below:

TABLE

| | Solids | Viscosity (cps) | | | |
|---|---|---|---|---|---|
| | | 90° C. | 100° C. | 105° C. | 110° C. |
| Before Treatment | 68.1 | 3220 | 733 | 614 | 328 |
| Post Treatment | 68.6 | 232 | 167 | 149 | 132 |
| % Reduction | | 93 | 77 | 76 | 60 |

As may be seen, a significant reduction in viscosity was obtained which was retained two weeks after processing.

SUMMARY OF DISCLOSURE

In summary of this disclosure, the present invention provides a novel procedure for processing spent pulping chemicals from chemical pulping operations by using mechanical action to decrease the viscosity of the spent pulping chemicals which, in turn, may enable the solids content to be increased and/or the processability of black liquor to be improved and/or the efficiency of black liquor evaporators and recovery furnaces to be improved. Modifications are possible within the scope of this invention.

What we claim is:

1. A process of controlling the viscosity of black liquor from a pulping operation, which comprises subjecting the black liquor to physical conditions to effect shearing of black liquor macromolecules to decrease their molecular size and produce a decrease in viscosity of the black liquor of at least about 5%.

2. The process of claim 1 wherein said black liquor has a concentration of about 15 to about 90 wt%.

3. The process of claim 2 wherein said black liquor has a concentration of about 40 to about 80%.

4. The process of claim 3 wherein said black liquor is subjected to said physical conditions at an elevated temperature of about 75° to about 300° C.

5. The process of claim 4 wherein the elevated temperature is about 140° to about 200° C.

6. The process of claim 1 wherein said decrease in viscosity is effected by multiple ones of the shearing steps.

7. The process of claim 1 wherein the alkalinity of the black liquor is controlled to a value of at least about 2% following shearing of the black liquor.

8. The process of claim 1 which is carried out in the presence of a catalyst for degradation of said macromolecules under shear conditions.

9. A process of controlling the viscosity of black liquor from a pulping operation, which comprises subjecting the black liquor to physical conditions by passing the black liquor through a gap between a rotor and stator of a high shear mixer operating at a peripheral velocity of rotor of at least about 10 m/s with a gap between the rotor and stator at less than about 1 mm to effect shearing of black liquor macromolecules to decrease their molecular size and produce a decrease in viscosity of the black liquor of at least about 5%.

10. The process of claim 9 wherein said peripheral velocity is at least about 15 m/s and the gap is less than about 0.6 mm.

11. A process of decreasing the viscosity of black liquor from a pulping operation, which comprises:

providing a concentrated black liquor from the pulping of hardwood or softwood pulps having a solids content of about 40 to about 85 wt%, heating said concentrated black liquor to a temperature of about 75° to about 300° C., passing said concentrated black liquor through a high shear zone wherein macromolecules in said concentrated black liquor are subjected to physical conditions of high shear to effect, in a gap between a rotor and a stator of a high shear mixer operating at a peripheral velocity of rotor of at least about 10 m/s with the gap between rotor and stator of less than about 1 mm, molecular size reduction and achieve a decrease in viscosity of said concentrated black liquor of at least about 5%, and recovering the treated black liquor having decreased viscosity.

12. The process of claim 11 wherein said temperature is about 140° to about 200° C.

13. The process of claim 11 wherein said peripheral velocity is at least about 15 m/s and said gap is less than about 0.6 mm.

14. The process of claim 13 wherein said gap is about 0.2 to about 0.4 mm.

15. The process of claim 11 wherein the black liquor has an alkalinity which is controlled to a value of at least about 2% following shearing of the black liquor.

16. The process of claim 15 wherein said alkalinity is about 2.5 to about 4%.

17. The process of claim 11 which is carried out in the presence of a catalyst for molecular size reduction.

18. The process of claim 11 including the subsequent step of concentrating the recovered black liquor and repeating the process on the concentrated black liquor.

19. The process of claim 11 wherein multiple ones of said shearing steps is effected.

20. A process for decreasing the viscosity of black liquor from a pulping operation, which comprises processing the black liquor in equipment primarily intended to shear molecules for a time and at a temperature sufficient to effect a decrease in viscosity.

21. The process of claim 20 wherein said equipment comprises a high shear mixer comprising a rotor and a stator and said processing is effected by passing the black liquor through a gap between a rotor and stator.

22. The process of claim 20 wherein said black liquor has a concentration of about 40 to about 85% and said processing is effected at a temperature of about 140° to about 200° C. for a time sufficient to effect a decrease in viscosity of at least about 5%.

23. A process for decreasing the viscosity of black liquor from a pulping operation, which comprises processing the black liquor in equipment primarily intended to shear molecules and comprises a high shear mixer comprising a rotor and a stator by passing the black liquor through a gap between the rotor and stator wherein said high speed mixer is operated at a peripheral rotor velocity of at least about 10 m/s with a gap between rotor and stator of less than about 1 mm.

24. The process of claim 23 wherein said rotor velocity is at least about 15 m/s and said gap is less than about 0.6 mm.

25. The process of claim 24 wherein slid gap is about 0.2 to about 0.4 mm.

* * * * *